US011482239B2

(12) United States Patent
Coteli et al.

(10) Patent No.: US 11,482,239 B2
(45) Date of Patent: Oct. 25, 2022

(54) JOINT SOURCE LOCALIZATION AND SEPARATION METHOD FOR ACOUSTIC SOURCES

(71) Applicants: ASELSAN ELEKTRONIK SANAYI VE TICARET ANONIM SIRKETI, Ankara (TR); ORTA DOGU TEKNIK UNIVERSITESI, Ankara (TR)

(72) Inventors: Mert Burkay Coteli, Ankara (TR); Huseyin Hacihabiboglu, Ankara (TR)

(73) Assignees: ASELSAN ELEKTRONIK SANAYI VE TICARET ANONIM SIRKETI, Ankara (TR); ORTA DOGU TEKNIK UNIVERSITESI, Ankara (TR)

( * ) Notice: Subject to any disclaimer, the term of this patent is extended or adjusted under 35 U.S.C. 154(b) by 0 days.

(21) Appl. No.: 17/270,075

(22) PCT Filed: Sep. 16, 2019

(86) PCT No.: PCT/TR2019/050763
§ 371 (c)(1),
(2) Date: Feb. 22, 2021

(87) PCT Pub. No.: WO2020/060519
PCT Pub. Date: Mar. 26, 2020

(65) Prior Publication Data

US 2021/0225386 A1 Jul. 22, 2021

(30) Foreign Application Priority Data

Sep. 17, 2018 (TR) ..... 2018/13344

(51) Int. Cl.
*G10L 21/028* (2013.01)
*G10L 21/0272* (2013.01)
*G10L 21/0216* (2013.01)

(52) U.S. Cl.
CPC ..... *G10L 21/028* (2013.01); *G10L 21/0272* (2013.01); *G10L 2021/02166* (2013.01)

(58) Field of Classification Search
None
See application file for complete search history.

(56) References Cited

U.S. PATENT DOCUMENTS 9,558,762 B1 * 1/2017 Sieracki ..... G06V 40/33
2012/0045066 A1 * 2/2012 Nakadai ..... G10L 21/028 381/20

(Continued)

FOREIGN PATENT DOCUMENTS

JP 2014021315 A 2/2014
WO 2016100460 A1 6/2016

OTHER PUBLICATIONS

S. Hafezi, A. H. Moore and P. A. Naylor, "3D acoustic source localization in the spherical harmonic domain based on optimized grid search," 2016 IEEE International Conference on Acoustics, Speech and Signal Processing (ICASSP), 2016, pp. 415-419, doi: 10.1109/ICASSP.2016.7471708. (Year: 2016).*

(Continued)

*Primary Examiner* — Shaun Roberts
(74) *Attorney, Agent, or Firm* — Bayramoglu Law Offices LLC

(57) ABSTRACT

A method is provided for acoustic source direction of arrival estimation and acoustic source separation, via spatial weighting of the dictionary based display of the steered response function calculated for a certain number of directions from spherical harmonic decomposition coefficients obtained from microphone array recordings of the sound field. The usage of spatial band limited functions of plane waves to represent more complex directional maps of the sound field constitutes the algorithm. These functions are calculated for pre-defined directions on an analysis surface (Continued)

(such as a sphere). The directions of arrival of sound sources are calculated with the same method in order to group source estimates to localize sound sources. Thereby, directions of arrival can be obtained from the recordings of the sound sources captured by means of a microphone array and following this, sound sources can be separated by using this direction information or predetermined source arrival directions.

20 Claims, 5 Drawing Sheets

(56) References Cited

U.S. PATENT DOCUMENTS

2014/0192999 A1 7/2014 Sannino
2014/0226838 A1* 8/2014 Wingate ..... G10L 21/0272 381/111
2016/0099008 A1* 4/2016 Barker ..... H04R 25/505 704/233
2016/0372129 A1 12/2016 Nakadai et al.
2017/0075649 A1* 3/2017 Duong ..... G10L 21/0272
2018/0047407 A1* 2/2018 Mitsufuji ..... H04R 3/005
2018/0061398 A1 3/2018 Gomez et al.

OTHER PUBLICATIONS

L. Kumar and R. M. Hegde, "Near-Field Acoustic Source Localization and Beamforming in Spherical Harmonics Domain," in IEEE Transactions on Signal Processing, vol. 64, No. 13, pp. 3351-3361, Ju. 1, 2016, doi: 10.1109/TSP.2016.2543201. (Year: 2016).*

Sachin N Kalkur, et al., Joint Source Localization and Separation in Spherical Harmonic Domain Using a Sparsity Based Method, INTERSPEECH, 2015, pp. 1493-1497.

* cited by examiner

JOINT SOURCE LOCALIZATION AND SEPARATION METHOD FOR ACOUSTIC SOURCES

CROSS REFERENCE TO THE RELATED APPLICATIONS

This application is the national phase entry of International Application No. PCT/TR2019/050763, filed on Sep. 16, 2019, which is based upon and claims priority to Turkish Patent Application No. 2018/13344, filed on Sep. 17, 2018, the entire contents of which are incorporated herein by reference.

TECHNICAL FIELD

The invention is related to a method that enables acoustic source direction of arrival estimation and acoustic source separation, via the spatial weighting of a dictionary based representation of the steered response function calculated for a certain number of directions from spherical harmonic decomposition coefficients that are either obtained from microphone array recordings of the sound field or by using other means.

BACKGROUND

Microphone arrays comprising a plurality of microphones are used to record acoustic sources to extract spatial features of sound fields. The basic advantages of using a plurality of microphones instead of using a single microphone are the ability to estimate directions of arrival of sound sources and to filter and carry out the spatial analysis of sound fields. Estimation of the direction of arrival and separation of source signals that overlap in the time-frequency domain, comprises significant technical difficulties that negatively affect operation in real time. Moreover the available methods do not perform well in enclosed environments with a high level of reverberation. In some of the existing methods that use machine learning, problems such as speed and adaptation to different microphone arrays arise.

Due to the disadvantages mentioned above and the inadequacy of the existing solutions to solve the problem, it has been deemed necessary for a development to be carried out in the related technical field.

SUMMARY

The sound signals recorded by means of microphones in environments where a plurality of sound sources are active are called, the mixture of these sound sources. The main aim of the invention is to enable the separation of acoustic sources from their mixtures via the spatial weighting of a dictionary based representation of the steered response function calculated for a finite number of directions, using spherical harmonic decomposition coefficients that are either obtained from microphone array recordings of the sound field or by using other methods (e.g. synthesized). The template vectors present in the dictionary, used in dictionary based representations are called atoms. The algorithm disclosed in this invention is based on the use of vectors (i.e. in the linear algebraic sense) that comprise as its elements samples taken at a limited number of points of spatially band limited functions representing plane waves. These functions are calculated at pre-defined positions on the analysis surface (such as a sphere).

Atoms that can express sufficiently well the directional map obtained using the steered response function and the amplitudes of these atoms are determined. The directions of arrival of sound sources are also calculated using the same method by grouping sound source candidates using neighborhood relations. This way, directions of arrival can be obtained from the recordings of the sound sources captured by means of a microphone array. Subsequently, the direction information and/or predetermined source directions of arrival are used to separate sound sources.

One of the most basic methods used for sound source separation is called maximum directivity factor beamforming. When compared with maximum directivity factor beamforming, SIR (Signal to Interference Ratio), SDR (Signal to Distortion Ratio) and SAR (Signal to Artifacts Ratio) improvement in a range of 8-10 dB are obtained using the disclosed method in acoustic environments having a high reverberation time.

The structural and characteristic features and all of its advantages shall be explained clearly by means of the detailed description below and by referring to the figures that are attached.

The figures need not be scaled and details that are not critical for a clear understanding of the present invention may have been omitted. Apart from this, elements that are at least substantially identical or those that at least substantially have the same functions, have been shown with the same reference number.

DETAILED DESCRIPTION OF THE INVENTION

In this detailed description, the preferred embodiments of the invention are described such that they do not have any limiting effect but have been provided to further describe the subject matter.

Figure 1:
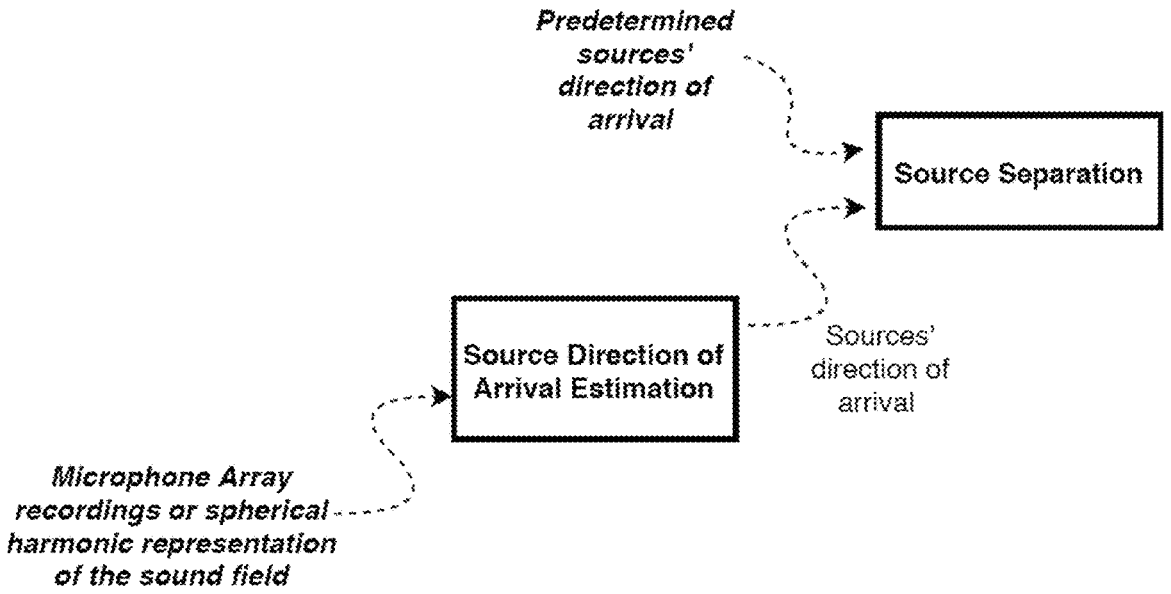
FIG. 1 is a flow diagram of the localization and separation of sound sources.

The invention comprises two different algorithms for the localization and the separation of sound sources. These algorithms can be used together or independently from each other. The block diagram showing the flow of the disclosed invention is shown in FIG. 1.

Figure 2:
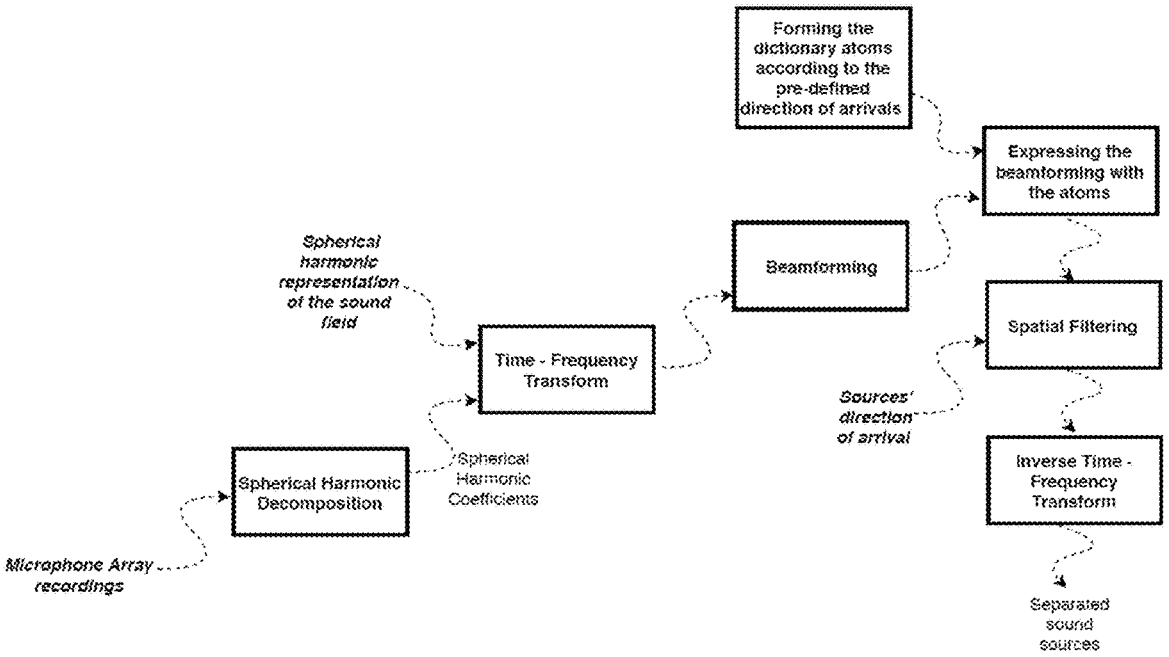
FIG. 2 is the flow diagram of the separation method.

FIG. 2 shows the block diagram of the source separation method. The inputs are sound source positions and microphone array recordings and the outputs are the separated sound files. The details of the different steps of the algorithms are given below.

A. Calculation of spherical harmonic decomposition coefficients: Harmonic series can be calculated using microphone array recordings and the positions of microphones that such arrays comprise. Harmonic series are used to define the sound field around the microphone array using spherically or cylindrically periodic functions. The disclosed method can also directly use the spherical harmonic decomposition of the sound field. In the case that such an input is present, this step does not need to be carried out.

B. Time-frequency transform: Each of the spherical harmonic coefficient series that are to be processed, is expressed with a suitable invertible representation in time frequency domain. The procedures in further steps are carried out separately for each time-frequency bin. As the procedures in step A are linear, they can also be carried out in reverse order.

C. Beamforming: The signals to be used in the next step are calculated for each time-frequency bin by means of steering a maximum directivity factor beam in a limited number of directions that are radially outward from the origin at which the spherical harmonic coefficients are obtained. This is achieved by weighting the spherical harmonic decomposition coefficients appropriately. The parameter that the algorithm uses is the number of directions at which the beam would be steered.

D. Creation of the dictionary atoms at the determined directions: For a plane wave, the directional response of the beam with the maximum directivity can theoretically be described as a closed form function, as described below. In this step, the atoms to be used in the expression of the steered beamforming function are obtained by sampling this function on a sphere (or another analysis surface) at a finite number of directions. This process can not only be carried out offline in order to accelerate the method, but it can also be applied separately for each time-frequency bin at runtime based on the sound source directions obtained as a result of earlier analysis.

E. Representation: This step involves the calculation of the representation of said beamforming results in an economical way according to certain criteria using the lowest number of atoms. The dictionary atoms mentioned above are used in this step. The result of this step is the calculation of complex or real valued coefficients for each of these atoms in the analyzed time-frequency bin by expressing the sound field as a linear sum of the previously calculated atoms in the specified directions.

F. Directional weighting: The dictionary atoms determined in step D are spatially filtered using the predetermined sound source directions. For this process, the coefficient that is calculated for each atom whose direction is known, is multiplied with a directional gain that emphasizes the direction that is to be separated. Here, it is possible to use a weighting function defined in closed form in order to calculate this directional gain. It is also possible to carry out directional weighting adaptively. A directionally weighted beamform can be obtained using the weighted coefficients and corresponding atoms for each time-frequency bin.

G. Reconstruction: Separated sound sources are reconstructed in the time domain, by inverting the new time-frequency representations that are obtained in the previous step.

Figure 3:
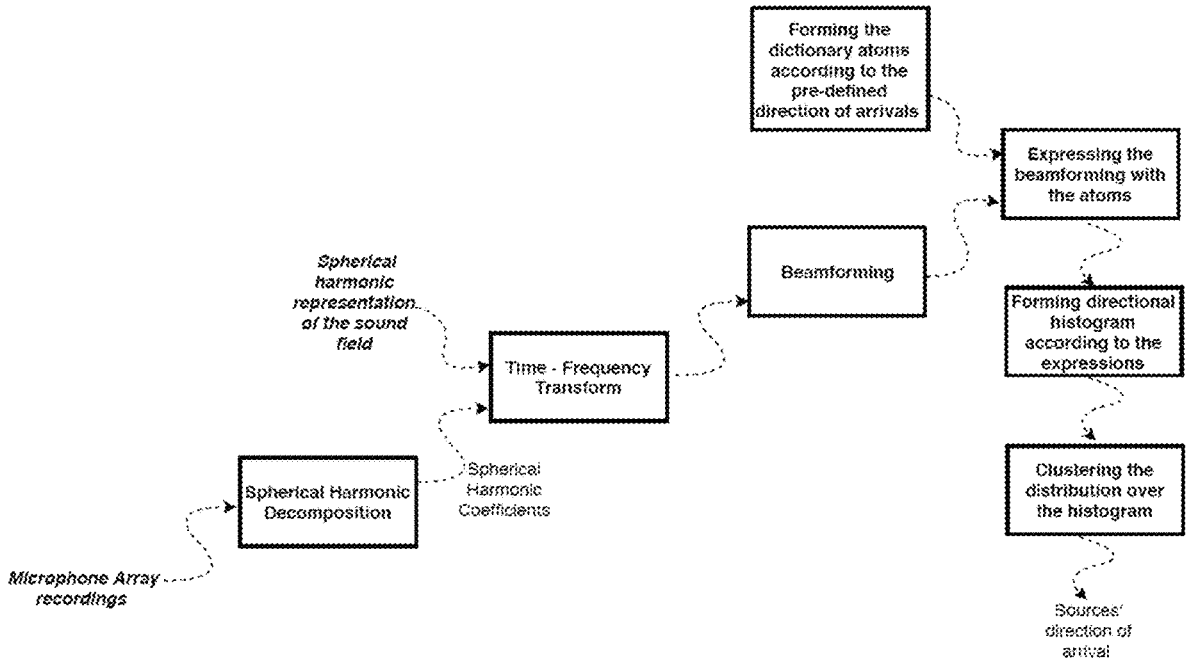
FIG. 3 is the flow diagram of the localization method.

FIG. 3 shows the block diagram of the positioning method. The above mentioned A, B, C, D, E steps are common to the two algorithms and the below mentioned additional steps are used only for source direction estimation.

H. Formation of a directional histogram based on selected atoms: The statistical distribution of atoms used to express the steered beamform at a certain time range is formed with a histogram or another method. If a histogram is used, the number of bins shall be selected to be the same with the number of atoms in the dictionary.

I. Clustering: The peak points of the distribution obtained as a result of the previous step are calculated. Direction of arrival can be estimated by using the neighborhood relations between the atoms that these peaks correspond to.

The definitions that were generally expressed above, have been used as a solution embodiment with the below mentioned preferred parameters. The spherical harmonic decomposition of the sound field is obtained from recordings made with a Rigid Spherical Microphone Array. Short time Fourier transform is used as the time-frequency transform. The Legendre impulse functions whose details are given below are sampled on the sphere to generate dictionary atoms. Orthogonal Matching Pursuit algorithm is used in the representation stage and maximum directivity factor beamforming is used for calculating steered beams. Von Mises function that is defined on the sphere is used for position dependent weighting. The distribution for direction of arrival estimation is obtained by using a histogram. In the preferred embodiment, the order of time-frequency transform and spherical harmonic decomposition has been swapped which leads to equivalent results due to the linearity of the concerned operations.

Short-Time Fourier Transform: Each of the signals obtained from the microphone array is transformed into the time-frequency domain by means of a short time Fourier transform. Although any kind of window function and length can be used for this process, in the preferred embodiment a 2048 sample Hann window has been used with 50% overlap.

The Calculation of Spherical Harmonic Decomposition: In this step the spherical harmonic decomposition for each time-frequency bin is calculated as follows:

$$p_{nm}(k) = \sum_{i=1}^{M} \gamma_i p(\Omega_i)[Y_n^m(\Omega_i)]^*$$

Here the M is the number of microphones, $\gamma_i$ is the related quadrature spherical weights, the k is the time-frequency bin index that has been obtained by using short time Fourier transform, $\Omega_i=(\theta_i, \phi_i)$ is the position of the microphone on the spherical surface. Spherical harmonic function, $Y_n^m$ is defined as follows:

$$Y_n^m(\Omega) = \sqrt{\frac{2n+1}{4\pi}\frac{(n-m)!}{(n+m)!}}\, P_n^m(\cos\theta)e^{im\phi}$$

Maximum directivity beamforming: This process is also known as the plane wave decomposition. It can be calculated as follows using spherical harmonic coefficients:

$$y(\Omega, k) = \sum_{n=0}^{N}\sum_{m=-n}^{n} \frac{p_{nm}(k)}{4\pi i^n b_n(kr_a)} Y_n^m(\Omega)$$

Wherein $\Omega=(\theta, \phi)$ is the steering direction of the maximum directivity factor beam, $j_n(.)$, $h_n^{(2)}(.)$, $j_n'(.)$, and $h_n^{(2)\prime}(.)$ are the spherical Bessel and Hankel functions, and the first-order derivatives thereof, $r_a$ is the radius of the spherical microphone, and frequency equalization function is given as:

$$b_n(kr) = j_n(kr) - \frac{j_n'(kr_a)}{h_n^{(2)\prime}(kr_a)} h_n^{(2)}(kr)$$

Plane Wave Legendre Impulse Function Definitions at the Determined Directions: Maximum directivity factor beamform for a limited number of S plane wave is defined as given below:

$$y_S(\Omega_q, k) = \sum_{s=1}^{S} a_s(k)\varphi(\Omega_q \mid \Omega_s)$$

Wherein $$\varphi(\Omega \mid \Omega_s) = \frac{N+1}{4\pi}\left[\frac{P_{N+1}(\cos\Theta_s) - P_N(\cos\Theta_s)}{P_1(\cos\Theta_s) - P_0(\cos\Theta_s)}\right],$$

is the Legendre impulse with a maximum at $\Omega_s=(\theta_s, \phi_s)$. This function is sampled at a finite number of points on the sphere to obtain the atoms in the dictionary used in Orthogonal Matching Pursuit algorithm in the following step.

Orthogonal Matching Pursuit: Orthogonal matching pursuit is an iterative method used to express steered response function in a given time-frequency bin using a small number of dictionary atoms.

As such, the steered response function at the given time-frequency bin can be expressed using a suitable selection of dictionary elements. The algorithm flow is as follows:

1. Maximum directivity factor beam is steered to calculate the steered response function at different directions covering the entire sphere for the analyzed time-frequency bin resulting in a directional map of the sound field for the given time-frequency bin.
2. The vector formed of these values is multiplied with the matrix comprising dictionary atoms and the atom corresponding to the highest value in the resulting vector is selected.
3. The approximation obtained using this atom is subtracted from the vector and a residual vector is formed.
4. The residual vector is multiplied with the matrix comprising dictionary atoms and the atom corresponding to the highest value in the resulting vector is selected.
5. The third and the fourth steps are repeated until the norm of the residual vector falls below a predetermined threshold value.
6. The coefficients of the approximation comprising a linear combination of atoms are obtained by using the Least Squares algorithm.

Figure 4:
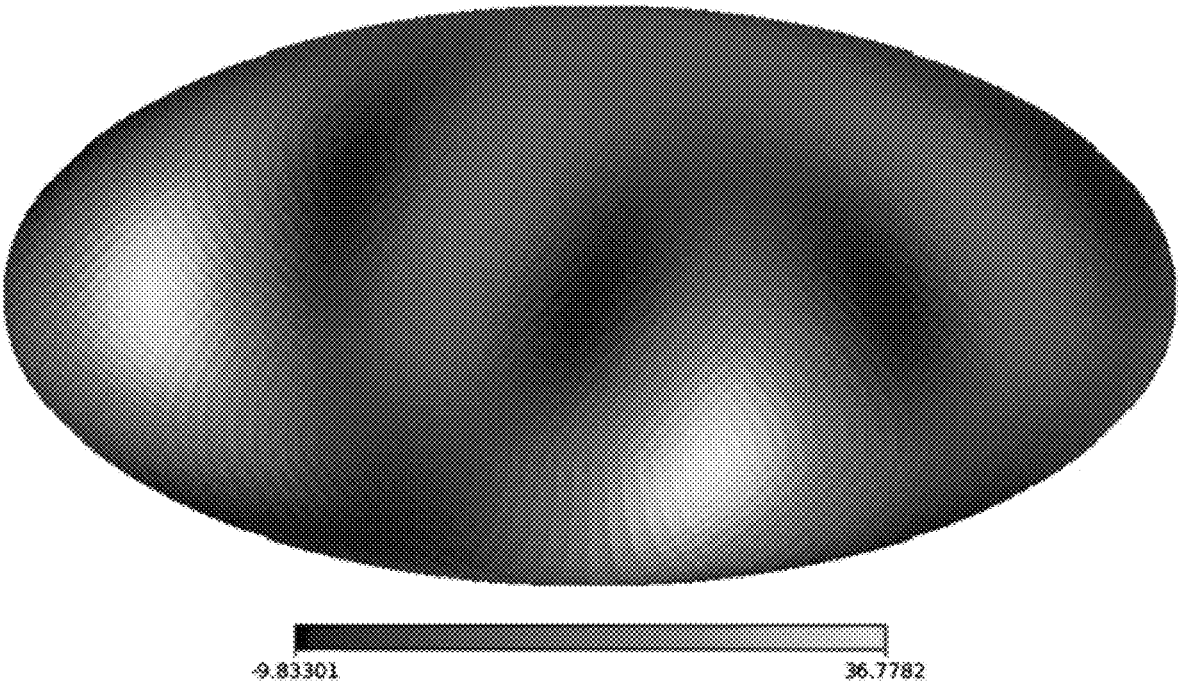
FIG. 4 shows the directional map obtained using steered response function that can be obtained from a single time-frequency bin.
Figure 5A:
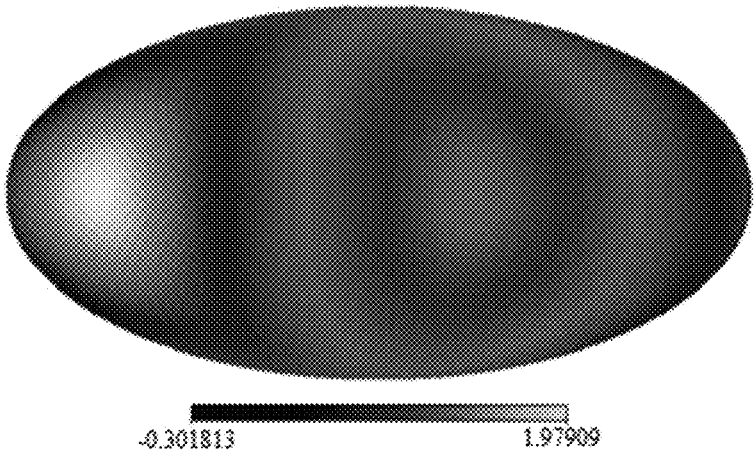
FIGS. 5A-5C show some dictionary elements that can be used in expressing the response function.
Figure 5B:
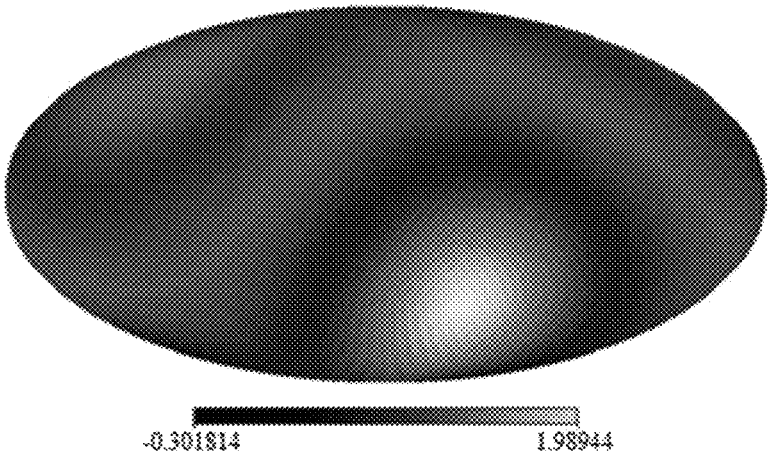
Figure 5C:
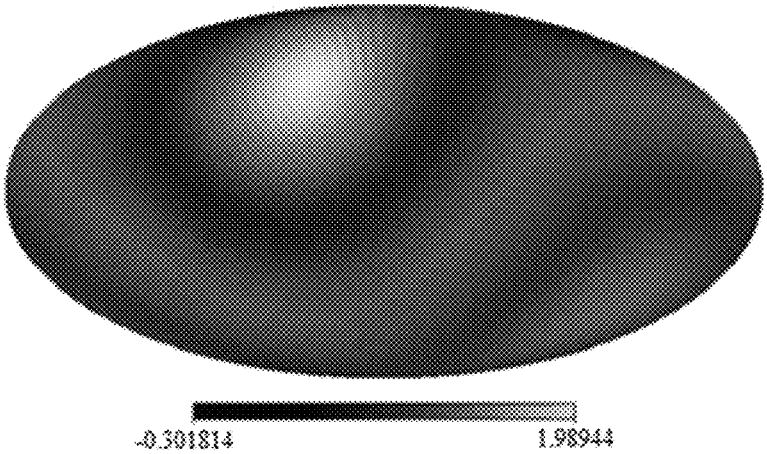

For example the steered response function in FIG. 4, can be obtained by using only the 1st and 2nd atoms of the dictionary atoms given in FIGS. 5A-5C. The third atom is not used.

Forming a Directional Histogram: The histogram calculated after finding the atoms that adequately express the steered response function by means of the orthogonal pursuit algorithm, shows how frequently these atoms are used in a given period of time.

Figure 6:
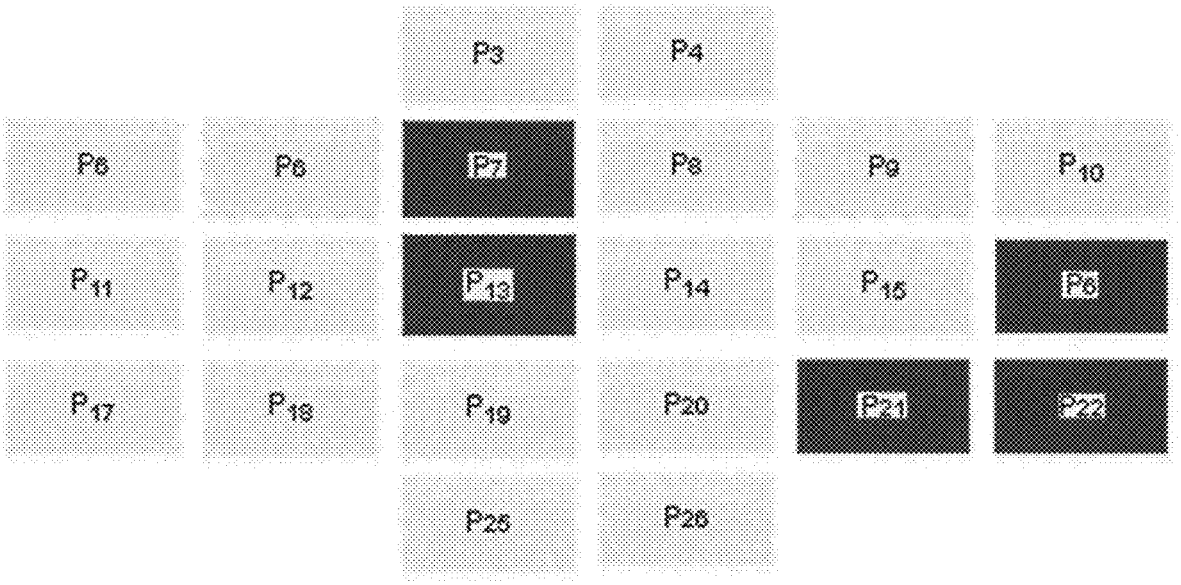
FIG. 6 shows the neighborhood relations (related to the clustering method for different atoms) of the peaks in the histogram.

Histogram Clustering and Source Localization: Source localization is based on a clustering principle based on the neighborhood relations of the directions of local maxima points in the histogram. The neighborhood relations of the positions is side information, and the directions where the sources are located are calculated by averaging the directions that the clustered positions are facing. The outputs of this stage are the components and the directions of the sound sources in the environment. The neighborhood relations of the peaks in the histogram is shown in FIG. 6. Accordingly Group 1 is comprised of P7, P13; Group 2 is comprised of P6, P21 and P22.

Figure 7:
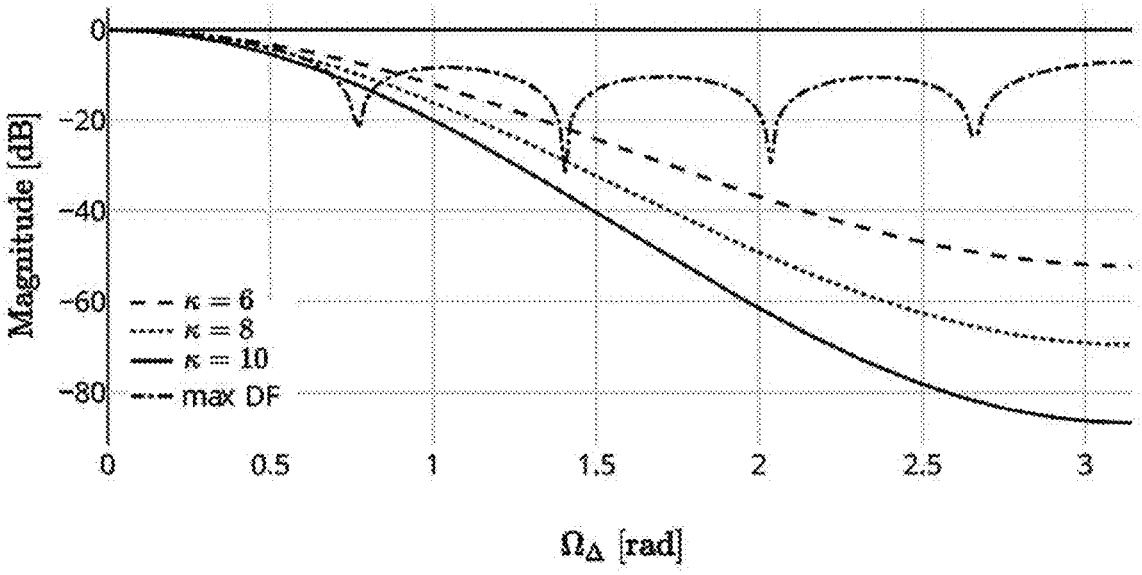
FIG. 7 graphically shows the directional response obtained for different κ values of the Von Mises function and the directional response of maximum directivity (max DF) beamforming.

Directional Weighting: The source directions that have been calculated and the linear weights corresponding to these directions are used at this stage. In the preferred embodiment of the invention, the linear weights corresponding to each atom is weighted by using Von Mises Functions with a mean in the direction of the desired sound source evaluated at the center direction of that atom. The spatial filter obtained by means of weighting by the Von Mises function is shown in FIG. 7, for different density parameters (κ). The maximum directivity factor beam is also shown for comparison. The κ value determines the spatial selectivity of the Von Mises function. When this value is small, it causes the method to filter its input at a wider directional range and increasing this value results in a sharper beam with higher selectivity resulting in more accurate separation of sources. In this step, a complex value is obtained for each of the sound sources that are to be separated at each time-frequency bin.

Inverse Short-Time Fourier Transform: The new time-frequency representations obtained for each of the each sound sources are transformed back into the time domain using the inverse short-time Fourier transform to obtain the separated source signals.

What is claimed is:

1. A method run by a computer for an estimation of an arrival direction from one or more sound source mixtures, and a separation of sound sources, comprising the following processing steps;

obtaining a spherical harmonic decomposition of one or more digital sound signal data from a plurality of microphones or sensors and/or a sound field as an input from an interface, in the case that the input is sound data from the plurality of microphones or sensors, carrying out a spherical harmonic decomposition of the sound data and providing a time-frequency representation of spherical harmonic decomposition coefficients, in the case that the input is the spherical harmonic decomposition coefficients, providing the time-frequency representation of the spherical harmonic decomposition coefficients, forming spatial filters, wherein the spatial filters have a predetermined selectivity at predetermined directions, forming beams from the spherical harmonic decomposition coefficients by using the spatial filters, obtaining a directional map of an amplitude of the sound field by steering the beams in a given number of directions, showing the directional map as a combination of a limited number of directional elements by using a redundant series of non-orthogonal template vectors and/or matrices, obtaining a usage frequency distribution of the non-orthogonal template vectors and/or matrices used in the time-frequency representation, calculating sound arrival directions from the usage frequency distribution, weighting the time-frequency representation depending on the sound arrival directions to obtain weighted representations, obtaining time-frequency transforms from the weighted representations, and determining and obtaining separated sound sources by carrying out inverse time frequency transforms.

2. The method according to claim 1, wherein values used for weighting are exemplified from a directional function having a single global maximum.

3. The method according to claim 2, wherein values used for weighting are adapted according to the sound arrival directions.

4. The method according to claim 2, wherein template series and/or matrices are formed of band limited functions.

5. The method according to claim 2, wherein template series and/or matrices are exemplified from direction localized functions.

6. The method according to claim 2, wherein template series and/or matrices are exemplified from real valued functions.

7. The method according to claim 1, wherein values used for weighting are adapted according to the sound arrival directions.

8. The method according to claim 1, wherein template series and/or matrices are formed of band limited functions.

9. The method according to claim 1, wherein template series and/or matrices are exemplified from direction localized functions.

10. The method according to claim 1, wherein template series and/or matrices are exemplified from real valued functions.

11. A method run by a computer for a separation of sound sources from a mixture of two or more sound sources, comprising the following processing steps;

obtaining a spherical harmonic decomposition and sound arrival directions, of one or more digital sound signal data from a plurality of microphones or sensors and/or a sound field as an input from an interface, in the case that the input is sound data from the plurality of microphones or sensors, carrying out a spherical harmonic decomposition of the sound data and providing a time-frequency representation of spherical harmonic decomposition coefficients, in the case that the input is the spherical harmonic decomposition coefficients, providing the time-frequency representation of the spherical harmonic decomposition coefficients, forming spatial filters, wherein the spatial filters have a predetermined selectivity at predetermined directions, forming beams from the spherical harmonic decomposition coefficients by using the spatial filters, obtaining a directional map of an amplitude of the sound field by steering the beams in a given number of directions, showing the directional map as a combination of a limited number of directional elements by using a redundant series of non-orthogonal template vectors and/or matrices, weighting the time-frequency representation using a function to obtain weighted representations, wherein the function depends on a direction, obtaining time-frequency transforms from the weighted representations, and determining and obtaining separated sound sources by carrying out inverse time frequency transforms.

12. The method according to claim 11, wherein values used for weighting are exemplified from a directional function having a single global maximum.

13. The method according to claim 11, wherein values used for weighting are adapted according to the sound arrival directions.

14. The method according to claim 11, wherein template series and/or matrices are formed of band limited functions.

15. The method according to claim 11, wherein template series and/or matrices are exemplified from direction localized functions.

16. The method according to claim 11, wherein template series and/or matrices are exemplified from real valued functions.

17. A method run by a computer for an estimation of arrival directions of one or more sound sources, comprising the following processing steps;

obtaining a spherical harmonic decomposition of one or more digital sound signal data from a plurality of microphones or sensors and/or a sound field as an input from an interface, in the case that the input is sound data from a plurality of microphones or sensors, carrying out a spherical harmonic decomposition of the sound data and providing a time-frequency representation of spherical harmonic decomposition coefficients, in the case that the input is the spherical harmonic decomposition coefficients, providing the time-frequency representation of the spherical harmonic decomposition coefficients, forming spatial filters, wherein the spatial filters have a predetermined selectivity at predetermined directions, forming beams from the spherical harmonic decomposition coefficients by using the spatial filters, obtaining a directional map of an amplitude of the sound field by steering the beams in a given number of directions showing the directional map as a combination of a limited number of directional elements by using a redundant series of non-orthogonal template vectors and/or matrices, obtaining a usage frequency distribution of the non-orthogonal template vectors and/or matrices used in the time-frequency representation, calculating sound arrival directions from the usage frequency distribution.

18. The method according to claim 17, wherein template series and/or matrices are formed of band limited functions.

19. The method according to claim 17, wherein template series and/or matrices are exemplified from direction localized functions.

20. The method according to claim 17, wherein template series and/or matrices are exemplified from real valued functions.

* * * * *